US006849228B2

(12) United States Patent
Thomas

(10) Patent No.: US 6,849,228 B2
(45) Date of Patent: Feb. 1, 2005

(54) BLOWING LANCE NOZZLE

(76) Inventor: Jacques Thomas, Avenue Nandrin 42, Esneux (BE), 4130

( * ) Notice: Subject to any disclaimer, the term of this patent is extended or adjusted under 35 U.S.C. 154(b) by 69 days.

(21) Appl. No.: 10/380,216

(22) PCT Filed: Sep. 11, 2001

(86) PCT No.: PCT/BE01/00148

§ 371 (c)(1),
(2), (4) Date: Mar. 12, 2003

(87) PCT Pub. No.: WO02/22892

PCT Pub. Date: Mar. 21, 2002

(65) Prior Publication Data

US 2003/0178186 A1 Sep. 25, 2003

(30) Foreign Application Priority Data

Sep. 15, 2000 (BE) ..... 2000/0588

(51) Int. Cl.[7] ..... C21B 11/00
(52) U.S. Cl. ..... 266/225; 266/270
(58) Field of Search ..... 266/225, 268, 266/270

(56) References Cited

U.S. PATENT DOCUMENTS

| | | | | |
|---|---|---|---|---|
| 4,432,534 A | | 2/1984 | Zanetta | |
| 4,702,462 A | * | 10/1987 | Fritz | 266/225 |
| 4,951,928 A | | 8/1990 | Eysn et al. | |
| 6,217,824 B1 | * | 4/2001 | Leczo et al. | 266/225 |
| 6,234,406 B1 | | 5/2001 | Thomas | |
| 6,599,464 B1 | * | 7/2003 | Feldhaus | 266/225 |

FOREIGN PATENT DOCUMENTS

| | | | | |
|---|---|---|---|---|
| AT | 313 945 | | 3/1974 | |
| DE | 73 37 989 | | 1/1974 | |
| DE | 27 12 745 | B1 | 7/1978 | |
| EP | 340 207 | A1 | 4/1989 | |
| GB | 1 591 585 | | 6/1981 | |
| GB | 299 07 794 | U1 | 7/1999 | |
| JP | 08302414 | A * | 11/1996 | 266/225 |
| WO | 96 23082 | A1 | 8/1996 | |
| WO | 97 00973 | A1 | 1/1997 | |

OTHER PUBLICATIONS

Increase of the Life of Oxygen Lance Tips of 350–Ton Basic Oxygen Furnaces, Suschenko A. V. et al, Steel in Translation, GB, The Institute of Materials, London, vol. 26, No. 5 Dec. 1996, pp. 21–25.

Patent Abstracts of Japan, vol. 11, No. 53, (C–404), Feb. 19, 1987 & JP 61 213311 (Nippon Kokan KK), Sep. 22, 1986.

* cited by examiner

*Primary Examiner*—Scott Kastler
(74) *Attorney, Agent, or Firm*—Sughrue Mion, PLLC

(57) ABSTRACT

A blowing lance nozzle (1) having: a central tube (2) supplying stirring gas, an inner tube (5) for intake of a cooling liquid, an outer tube (10) for evacuation of the cooling liquid, a heat exchanging space (13), and an outlet conduit (15) for the stirring gas exiting from each orifice (4) in the front wall (3). The front wall (12) has a central recess (16) which is oriented towards the central orifice (8) and has a recess height/recess base ratio not less than 0.35. The heat exchanging space has a section for allowing passage of the cooling liquid through the space at a speed which is substantially constant, so as to obtain a cooling liquid passage speed, through the space, which is more or less constant.

14 Claims, 3 Drawing Sheets

BLOWING LANCE NOZZLE

The present invention relates to a blow-lance nose intended for stirring baths, comprising a central tube for supplying stirring gas, closed at one end turned towards the bath by a first front wall provided with at least one opening, an internal tube forming with the central tube a first annular cavity for the passage of a cooling liquid and closed at one end turned towards the bath by a second front wall having a central opening and one passage orifice per opening provided in the said first front wall, an external tube forming with the internal tube a second annular cavity for the passage of the cooling liquid and closed at one end turned towards the bath by a third front wall having one outlet orifice per opening provided in the said first front wall, a heat exchange space which is situated between on the one hand the said second front wall and the said third front wall and on the other hand the said central opening and the said second annular cavity, and in which the cooling liquid flows, and an outlet conduit for the stirring gas leaving each opening in the said first front wall and going as far as an aforementioned corresponding outlet orifice, passing through an aforementioned corresponding passage orifice in a manner which is impervious to the cooling liquid.

Blow-lance noses of this type have been known for a long time. The blow-lance noses described in EP-A-0 340 207, WO-97/000973 and U.S. Pat. No. 4,432,534 can be cited by way of examples.

In order to stir steelworks converter baths with oxygen jets, the lance noses operate at a distance of 1 to 2.5 m from the bath whilst the bath has a temperature of around 1400° C. Under these operating conditions, the temperature of the nose can increase rapidly to 400° C. and must remain in this environment for approximately 20 minutes. Then, when the lance is withdrawn, the nose rapidly returns to ambient temperature, that is to say 20° C.

Provision is therefore made for constructing the front walls of the lance noses from a material which is a very good conductor of heat, for example copper, to allow an effective as possible heat exchange with a cooling liquid which flows at great speed along this wall, inside the nose. However, the lance noses already known have the drawback of offering cooling which is not uniform over the entire surface of this wall exposed to variations in thermal conditions which are extremely critical. This results in mechanical tensions between the various areas of the wall.

Moreover, cavitation phenomena are frequently observed in the cooling liquid following local pressure drops therein. This cavitation has the effect of causing poor cooling between the cooling liquid and the wall to be cooled, the heat exchangers being much less good between a gaseous phase and a solid phase than between a liquid phase and a solid phase.

Many attempts have been made to smooth out the flow of the cooling liquid inside the lance nose, for example by forming slight depressions in the external front wall of the nose (see for example U.S. Pat. No. 4,432,534 and WO 96/23082). These arrangements do however have the drawback of not offering sufficient heat exchange surface, in particular in the central area of the nose.

There is also provided, in the central area of the lance nose described in EP-A-0340207, a large depression onto which secondary jets of cooling liquid are directed, which has the effect of causing turbulence in the liquid flow.

The aim of the present invention is to propose a lance nose which is capable of sustaining the high stresses to which it is subjected, during a significant number of successive uses, whilst providing a lance nose which is simple to manufacture and of justifiable cost.

This problem is resolved, according to the invention, by a blow-lance nose as described at the start, in which the said third front wall has a central depression which is directed towards the said central opening and which has a ratio between height of depression and base of depression equal to or greater than 0.35, and the aforesaid heat exchange space has a cross-section for the passage of the cooling liquid which is substantially constant, so as to obtain a speed of passage of the cooling liquid through this space which is approximately constant, in the presence of the said depression.

Through such a depression, the heat exchange surface increases greatly compared with an identical surface of the heat front coming from the bath, without causing any turbulence or cavitation in the liquid. Advantageously, the said central depression has a ratio between height and base equal to or greater than 0.4, in particular 0.5, and preferentially even 0.8.

The expression "cross-section for the passage of cooling liquid" means that the cross-sections referred to are taken perpendicular to the direction of flow of the cooling liquid in the heat exchange space.

In this way, at a constant flow rate, the flow rate/cross-section ratio remains constant and therefore the speed of passage of the liquid also remains constant. It can thus be ensured that, at a given passage speed, and at the critical temperature of the front wall to be cooled, there is no risk of any cavitation phenomenon occurring in the cooling liquid, which in general is water. Advantageously, for the front wall temperatures indicated above, a passage speed of the liquid flow of between 8 and 12 m/sec will be provided.

Substantially constant cross-section means, according to the invention, that the surface area of this cross-section cannot vary within limits greater than 10%.

According to one embodiment of the invention, the lance nose comprises several aforementioned passage conduits disposed around a central axis and the said central depression extends from the said outlet orifices of these conduits. The base of the depression is thus advantageously maximal and affords improved efficacy of the heat exchange in the depression. In an improved manner, the third front wall has an outside diameter and the base of the said depression is a circle having a diameter equal to at least 0.25× the said external diameter, preferably at least 0.33× this outside diameter. The central depression is thus according to the invention in no way a small central hollow provided in the wall of the nose in order to reinforce the rigidity thereof.

According to one advantageous embodiment of the invention, the said third front wall has a central depression in the form of a cone.

According to an improved embodiment of the invention, the said second front wall has, around the central opening, a central deformation in the form of a truncated cone which is directed towards the said first front wall. The said cone and the said truncated cone preferably have a common axis and the central depression in the form of a cone forms with this axis an angle greater than the angle formed between this axis and the central deformation in the form of a truncated cone. In this way, even in the heat exchange space situated between the central depression of the third front wall and the central deformation of the second front wall, the cross-section can remain constant and the speed of passage of the flow liquid remains there too equivalent to that obtained along the entire third front wall.

According to a particular embodiment of the invention, the central depression is covered at least partially with a protective screen made from a material with high thermal resistance. This may be a plate in the form of a disc which is carried by the central depression or clamped against it and which therefore requires no welding to fix it. The heat exchange between the cooling liquid and the third front wall remains unchanged, whilst a major part of the surface area of the third front wall is sheltered from excessive overheating.

Other embodiments of the lance nose according to the invention are indicated in the accompanying claims.

Other details and particularities of the invention will emerge from the description given below, non-limitingly, of example embodiments of the invention, and making reference to the accompanying drawings.

In the various drawings, the identical or similar elements are designated by the same references.

Figure 1:
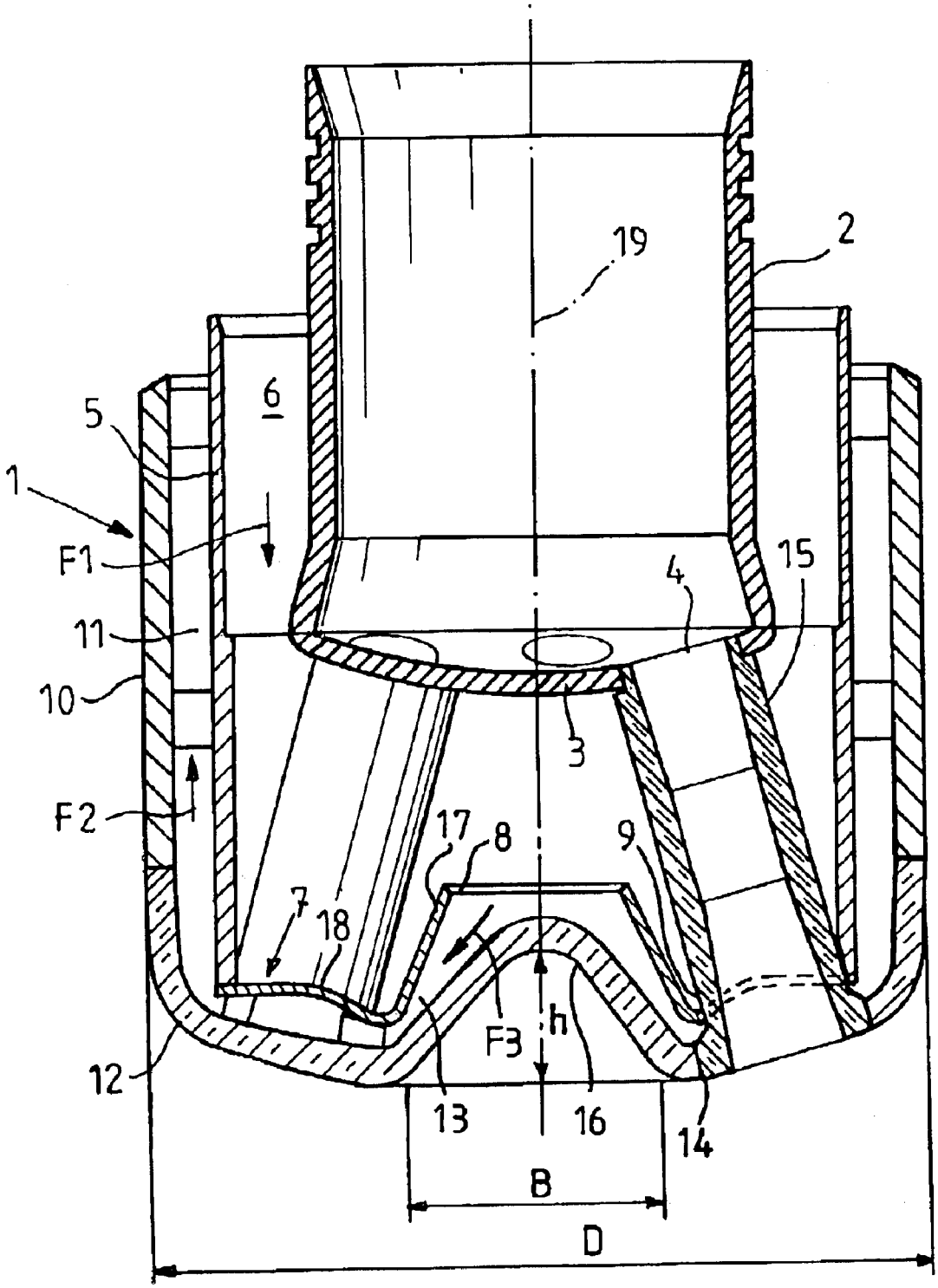
FIG. 1 depicts a view in axial section of a blow-lance nose according to the invention.

FIG. 1 depicts a blow-lance nose 1. This nose comprises a central tube 2 for supplying stirring gas. This central tube 2 is closed by a front wall 3 which, in the example illustrated, is provided with several openings 4.

An internal tube 5 is arranged coaxially around the central tube 2 and these tubes form between them an annular cavity 6 which, in the example illustrated, serves to supply cooling water in the direction of the arrow $F_1$. This internal tube 5 is closed by a front wall 7 which is referred to as a separator. This front wall 7 is provided with a central opening 8 and an orifice 9 in line with each opening 4 in the central tube 2.

An external tube 10 is arranged coaxially around the central tube 2. This external tube is generally made from steel and forms with the internal tube 5 an annular cavity 11 which, in the example illustrated, serves for discharging cooling water in the direction of the arrow $F_2$. This external tube 10 is closed by a front wall 12 which faces the bath to be stirred and which is therefore subjected to critical heat stresses, as explained above. Advantageously this front wall is made from a material which is a good conductor of heat, for example copper, to allow a heat exchange which is as effective as possible between the heated front wall 12 and the cooling water passing through the heat exchange space 13 which is situated between the front wall 7 of the internal tube 5 and the front wall 12 of the external tube 10. In the example embodiment illustrated, the cooling water coming from the cavity 6 passes through the central opening 8 in the heat exchange area 13. There it flows in the direction of the arrow $F_3$ towards the outside, that is to say towards the cavity 11.

The front wall 12 is also provided with an outlet orifice 14 in line with each opening 4 provided in the front wall 3 and with each passage orifice 9 provided in the front wall 7. In each of these aligned orifices and openings there is arranged an outlet conduit 15 for the ejection of stirring gas outside the lance nose. These conduits are advantageously produced from an erosion-resistant material, for example bronze, and are directed obliquely with respect to the axis 9 of the lance nose.

As is clear from the example embodiment illustrated, the external front wall 12 is, according to the invention, provided at its centre with a depression 16 in the form of a cone, which is directed towards the central opening. This depression is preferably sufficiently pronounced to have a ratio between the height of the internal wall of the cone (h) and the base diameter (B) equal to or greater than 0.35. In the case illustrated this ratio is equal to approximately 0.5. In this way, the heat exchange area 13 is greatly increased for the same heat front to which the lance nose is subjected, and hence an increased efficacy in the cooling of the front wall 12. It is entirely advantageous, as depicted, that this depression 16 extends from the outlet conduits 15 and therefore forms a cone whose base is maximal. In the example illustrated, the ratio between the base B of the depression and the outside diameter D of the front wall 12 is approximately 0.33. Moreover, through the deep depression, the central area of the external front wall, which is thermally the most stressed, is separated to the maximum possible extent from the surface of the bath.

Figure 3:
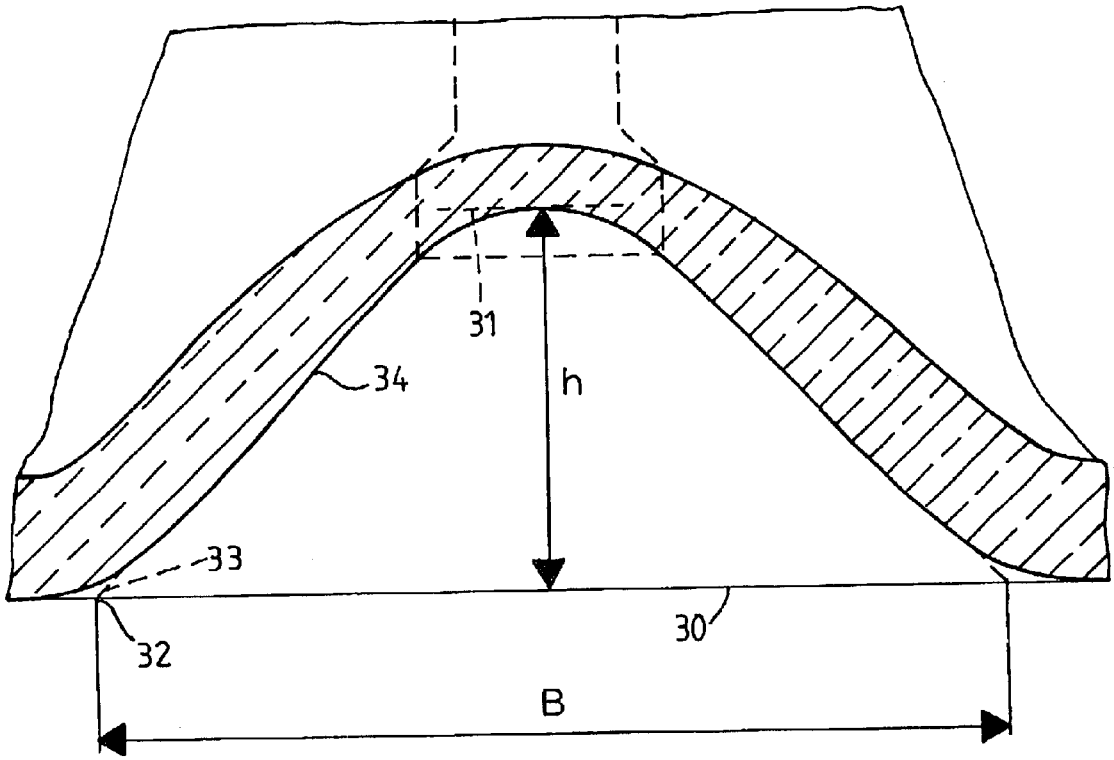
FIG. 3 depicts a detail of a lance nose according to the invention for illustrating the method of measuring the parameters necessary to the invention.

FIG. 3 illustrates how the parameters h and B of the lance nose according to the invention must be measured.

The height h is calculated between on the one hand the bottom tangent plane 30 of the lance nose perpendicular to the axis 19 and the parallel plane 31 tangent to the top of the depression. If an element foreign to the depression is provided at the top thereof, such as for example the tie rod 20 in FIG. 2, the plane 31 remains in the position which it would have if this foreign element did not exist. The top of the depression must then be considered to be a virtual point to be taken into account in the measurement.

The base B is situated in the bottom tangent plane 30. It is circumscribed by the line 32 resulting from the intersection between this plane 30 and the extension 33 of the internal faces 34 of the depression. Account is therefore not taken of the rounded parts.

As can be seen in FIG. 1, the outside diameter of the front wall 12 is taken where its value is maximal.

The front wall 7, serving as a separator between the water supply and the water outlet, also has a central deformation 17 directed towards the front wall 3. This deformation 17 has the shape of a truncated cone open towards the top through the central opening 8.

This truncated cone 17 is coaxial with the cone formed by the depression 16, their common axis being the axis 19 of the lance nose. The cone of the depression 16 forms with the axis 19 an angle larger than the angle formed between this axis and the imaginary extension of the truncated cone 17 as far as this axis.

As a result the truncated cone 17 is further away from the cone 16 at its apex than at its base. However, at its apex, the truncated cone is narrower. Therefore, the cross-section of the heat exchange space situated between the front walls 7 and 12, which is measured in a plane perpendicular to the direction of flow of the cooling liquid, remains constant even in the presence of the central depression 16 provided in the example embodiment illustrated in FIG. 1.

Moreover, at the outlet conduits 15, the cooling liquid can pass only through the interstices situated circumferentially between these conduits in the heat exchange space 13. Consequently, in order to maintain at this point a constant cross-section of flow for the cooling liquid and therefore a constant speed of flow at a given flow rate, an inward bulge 18 in the front wall 7 serving as a separator is provided in each of the aforesaid interstices.

The lance nose according to the invention is therefore arranged so as to provide over the entire extent of the heat exchange area 13 a constant cross-section of flow for the cooling liquid. At a given flow rate of the water supply there is obtained a ratio between this flow rate (d) and the cross-section (S) which remains constant during the functioning of the lance, this ratio corresponding to a speed of passage of the flow liquid expressed in m/sec. Advantageously, the flow rate and the cross-section will be determined so as to obtain a speed of flow which is approximately constant and between 8 and 12 m/sec. The phenomenon of cavitation can thus be avoided to the maximum possible extent, which greatly improves the efficacy of the heat exchange obtained in the nose.

Figure 2:
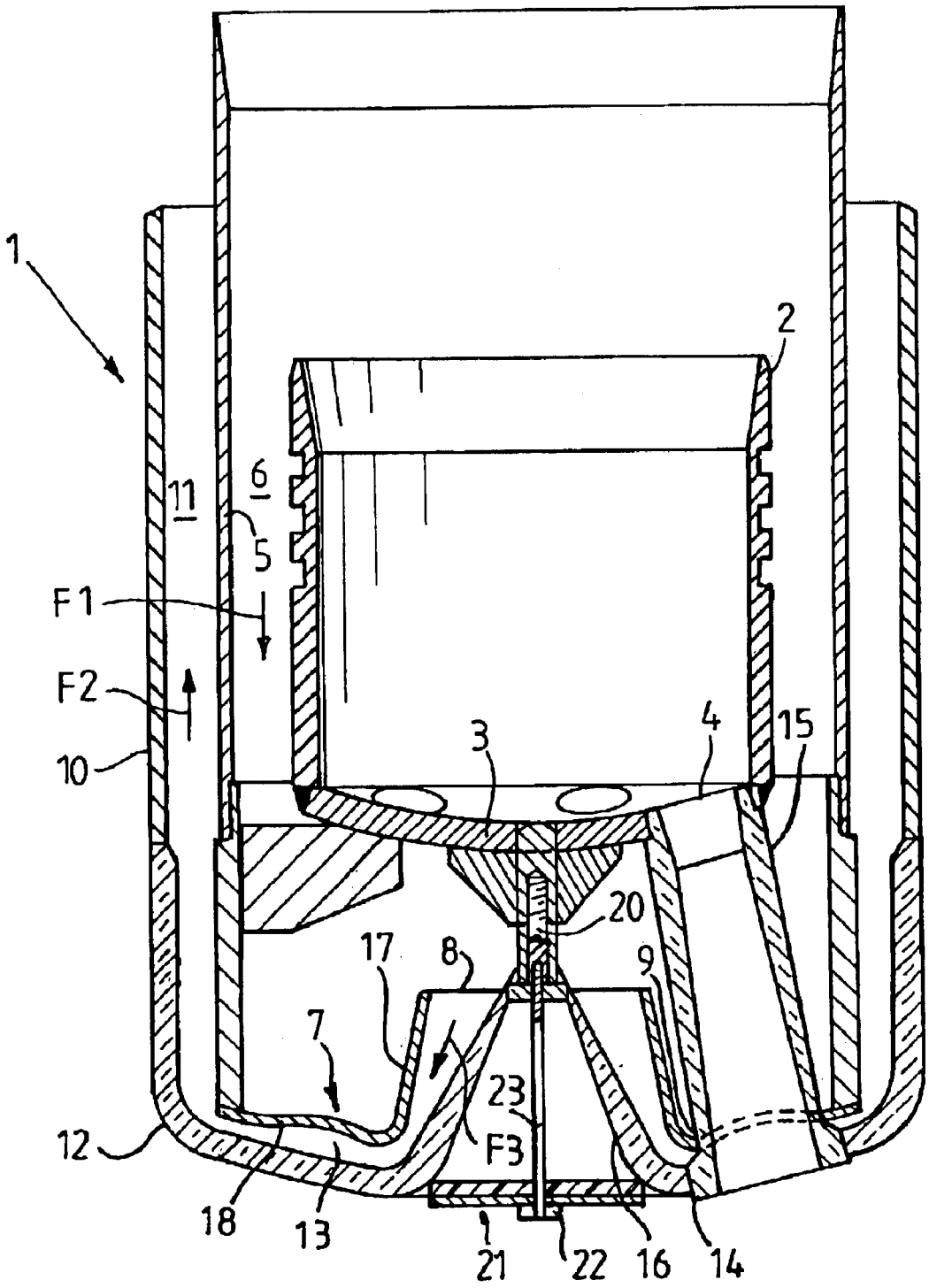
FIG. 2 depicts a view in axial section of a variant embodiment.

In the example embodiment illustrated in FIG. 2, a lance nose is depicted which is differentiated from the one depicted in FIG. 1 by the fact that the depression 16 is more pronounced. The top of the depression 16 projects through the opening 18 and therefore even emerges in the space between the front walls 3 and 7, which makes it possible to obtain a ratio of h to B equal to or greater than 0.8. In order better to ensure the mechanical strength of the depression 16, it is possible to provide a retaining element, for example a tie rod 20, between the top of the depression and a nut arranged on or in the front wall 3 of the central tube 2.

Moreover, the central depression 16 is, in this example embodiment, completely covered with a heat-resistant plate 21. In this way, whilst allowing unchanged heat exchange between the cooling water and the cone formed by the depression 16, the central part of the lance nose is thermally insulated from the heat in the bath, which increases the efficacy of the heat exchange and affords a longer service life for the lance nose.

In the example embodiment illustrated in FIG. 2, the plate 21 is composite, that is to say it has an external layer made from a refractory material, for example ceramic, or refractory steel, and an internal layer made from a thermally insulating material such as for example fibrous alumina.

In the example illustrated, this plate is simply clamped between the head 22 of a threaded rod 23 passing through the plate 21 and screwed into a thread provided in the head of the tie rod 20. Other methods of fixing this plate could of course be provided.

Comparative tests were carried out under the same conditions in baths in a steelworks.

The tests were carried out with conventional noses from three competing firms (Tests I to III in the table below), noses manufactured by the applicant with a slight central depression where the ratio h/B=0.15 and the ratio D/B=0.15 (Test IV) and noses according to the invention where the ratio h/B=0.44 and the ratio D/B=0.30 (Test V).

TABLE

| Tests | I | II | III | IV | V |
|---|---|---|---|---|---|
| Mean service life | 130 | 130 | 223 | 282 | 366 |

The service life of a nose is calculated on the number of casts which it has been possible to stir before having to scrap this nose. As can be seen from this table, the improvement in the mean service life of the noses according to the invention is remarkable and completely unexpected.

It must be understood that the present invention is in no way limited to the embodiments described above and that many modifications can be made thereto without departing from the scope of the accompanying claims.

What is claimed is:

1. Blow-lance nose intended for stirring baths, comprising a central tube for supplying stirring gas, closed at one end turned towards the bath by a first front wall provided with at least one opening, an internal tube forming with the central tube a first annular cavity for the passage of a cooling liquid and closed at one end turned towards the bath by a second front wall having a central opening and one passage orifice per opening provided in the said first front wall, an external tube forming with the internal tube a second annular cavity for the passage of the cooling liquid and closed at one end turned towards the bath by a third front wall having one outlet orifice per opening provided in the said first front wall, a heat exchange space which is situated between on the one hand the said second front wall and the said third front wall and on the other hand the said central opening and the said second annular cavity, and in which the cooling liquid flows, and an outlet conduit for the stirring gas leaving each opening in the said first front wall and going as far as an aforementioned corresponding outlet orifice, passing through an aforementioned corresponding passage orifice in a manner which is impervious to the cooling liquid, wherein the said third front wall has a central depression which is directed towards the said central opening and which has a ratio between height of depression and base of depression equal to or greater than 0.35, and in that the aforesaid heat exchange space has a cross-section for the passage of the cooling liquid which is substantially constant, so as to obtain a speed of passage of the cooling liquid through this space which is approximately constant, in the presence of the said depression.

2. Lance nose according to claim 1, comprises several aforementioned outlet conduits disposed around a central axis, the said central depression extends from the said outlet orifices of these outlet conduits.

3. Lance nose according to claim 2, wherein the third front wall has an outside diameter and in that the base of the said depression is a circle having a diameter equal to at least 0.25× the said external diameter.

4. Lance nose according to one of claim 1, wherein the said second front wall has, around the central opening, a central deformation in the form of a truncated cone, which is directed towards the said first front wall.

5. Lance nose according to claim 4, wherein the central depression has the shape of a cone, that said cone and the said truncated cone have a common axis and in that the central depression in the form of a cone forms with this axis an angle greater than the angle formed between this axis and the central deformation in the form of a truncated cone.

6. Lance nose according to claim 1, wherein the central depression projects through the central opening towards the said first front wall.

7. Lance nose according to claim 1, comprising a retaining element which fixes a top of the central depression to the said first front wall.

8. Lance nose according to claim 1, wherein the central depression is at least partially covered with a protective screen made from a material with high thermal resistance.

9. Lance nose according to claim 8, wherein the protective screen is carried on a rod fixed to the top of the central depression.

10. Lance nose according to claim 1, comprises several aforementioned outlet conduits separated circumferentially by interstices, the said second front wall having at each aforementioned interstice a bulge directed inwards.

11. Lance nose according to claim 1, having a ratio between the depression height and the depression base equal to or greater than 0.4.

12. Lance nose according to claim 1, wherein said speed of passage of the cooling liquid through said heat exchange space is between 8 and 12 m/sec.

13. Lance nose according to claim 11, wherein said ratio is equal to or greater than 0.5.

14. Lance nose according to claim 11, wherein said ratio is equal to or greater than 0.8.

* * * * *